United States Patent [19]

Yamasaki

[11] Patent Number: 5,052,376

[45] Date of Patent: Oct. 1, 1991

[54] DRIVE SECTION FOR AUTOMATIC MASSAGING APPARATUS

[75] Inventor: Yoshikiyo Yamasaki, Osaka, Japan

[73] Assignees: Kabushiki Kaisha Fuji Iryoki; Kabushiki Kaisha Japan Health, both of Osaka, Japan

[21] Appl. No.: 407,893

[22] Filed: Sep. 15, 1989

[51] Int. Cl.[5] ..... A61H 7/00

[52] U.S. Cl. ..... 128/52; 128/33; 128/60

[58] Field of Search ..... 128/33, 51, 52, 48, 128/49, 60; 74/443; 267/136, 141.3, 141.4, 141.5, 141.7, 182

[56] References Cited

U.S. PATENT DOCUMENTS

| | | | |
|---|---|---|---|
| 3,320,824 | 5/1967 | Riley et al. | 74/443 |
| 3,330,515 | 7/1967 | Janssen et al. | 267/141.4 X |
| 3,371,899 | 3/1968 | Johnson | 267/136 X |
| 3,385,543 | 5/1968 | Jäkel et al. | 267/141.4 X |
| 3,839,922 | 10/1974 | Hiersig et al. | 74/410 |
| 4,149,531 | 4/1979 | Tanaka | 128/52 |
| 4,615,336 | 10/1986 | Fijimoto | 128/52 |
| 4,718,408 | 1/1988 | Barreiro | 128/52 |
| 4,793,200 | 12/1988 | McDonald | 74/331 |

*Primary Examiner*—Edgar S. Burr
*Assistant Examiner*—E. P. Raciti
*Attorney, Agent, or Firm*—Flynn, Thiel, Boutell & Tanis

[57] ABSTRACT

Drive mechanism in an automatic massaging apparatus arranged to smoothly effect operational switching for a pair of massaging rollers which carry out a massaging operation and a percussion operation, and which reduces mechanical noise which occurs when carrying out either operation. The drive mechanism comprises two independently rotatable gears which respectively rotate with forward and reverse rotation of a main drive shaft which is rotated by a reversing actuating motor. Two different bearing-supported subordinate shafts are respectively engaged with the gears. Resilient members are respectively inserted between a first subordinate gear and a gearbox, and between a rotational gear and the gearbox. A connecting rod and a connecting member are arranged in such a way as to connect each of the massaging rollers to a respective end of each of the subordinate shafts.

9 Claims, 3 Drawing Sheets

DRIVE SECTION FOR AUTOMATIC MASSAGING APPARATUS

FIELD OF THE INVENTION

This invention relates to the drive mechanism for an automatic massaging apparatus arranged to carry out two types of movement such as a massaging movement and a percussion movement with massaging balls or rollers by means of a single motor, and more specifically it relates to a drive mechanism in an automatic massaging apparatus having a silencing structure so that a pleasant massage can be carried out and the noise from the mechanical mechanism is prevented when the massaging rollers are in operation.

BACKGROUND OF THE INVENTION

Conventional chair-type automatic massaging apparatuses, an example of which is disclosed in U.S. Pat. No. 4 615 336, have been devised in such a way as to carry out a desired massage on the human back. Such apparatus is conventionally provided, in the backrest of the chair, with a perpendicular screw shaft with freedom of forward and reverse rotation by means of a drive motor. A drive mechanism equipped with a massaging ball or roller is linked in screw fashion to the screw shaft. A massaging movement and a percussion movement is effected by the massaging ball, and the drive mechanism is constructed with freedom of vertical movement.

Further, in recent years, there have also been disclosures concerning apparatuses provided with freely rotatable rollers on the left and right sides, instead of massaging balls, whereby it is possible to effect a rolling massage on the human back, backbone and neighboring regions by continuously raising and lowering these rotating rollers.

Moreover, as shown in FIG. 1, a drive mechanism as used in conventional automatic massaging apparatuses of this type has been constructed in such a way as to effect two different types of operation for the above-mentioned massaging ball by means of forward and reverse rotation of an actuating motor 18 provided in the gearbox 15 in such a way that the two output shafts 16, 17 which are connected to the supporting bar of the massaging ball are respectively appropriately driven. A drive gear 20 is attached to the end of the drive shaft 19 of the actuating motor 18, and 21 is a shaft for transmitting the rotation of a large-diameter gear 22, which intermeshes with the gear 20, in such a way as to turn the main drive shaft 25 via the small-diameter gear 23 attached to its other end. The main drive shaft 25 is provided with a threaded portion 28 at one end in addition to rotatably supporting at its other end, the main drive gear 26. The gear 26 has provided in its center a drum-shaped through-hole 27, and meshes with the small-diameter gear 23. Two subordinate gears 29, 29' with differing diameters and provided in their centers with drum-shaped recessed portions 30 are rotatably supported on the center portion of the main drive shaft 25 in such a way that the respective recessed portions 30 face each other. Further, 31 is a pulley which is linked in screw fashion with the threaded portion 28 and arranged in such a way as to support the main drive shaft elastically, its outer circumference being retained via the balls 32 by a support ring 35 which is supported by a leaf spring 34 attached to a dividing wall 33. Pins 36, 37 are respectively provided on opposite vertical surfaces of the pulley 31. Said pins are arranged in such a way that one pin abuts against one of the drive pins 38, 39 as fixedly provided at opposite ends of the threaded portion 28 of the main drive shaft 25, depending upon the axial position of the main drive shaft 25.

Moreover, 24 is a bearing, 40 is a follower pin provided radially in the main drive shaft 25 in such a way as to be contained in the grooved portions 30 of the subordinate gears 29, 29', 41 is a slidable drive pin abutting in the through-hole 27 of the main drive gear 26, and 42, 42' are output gears provided on the ends of the two output shafts 16, 17 in such a way as to mesh respectively with the subordinate gears 29, 29'.

With the above-mentioned conventional drive mechanisms, although it is possible to carry out different operations with the two different output shafts 16, 17 using the forward and reverse rotation of the actuating motor 18, because the main drive shaft 25 is retained elastically, via the balls 32, by the support 35 which is supported by the leaf spring 34 attached to the dividing wall 33, there are disadvantages such as the creation of more than necessary resistance due to the support 35 which retains the main drive shaft 25, or the possible occurrence of an inability to switch drive between the output shafts 16, 17 due to the creation of a less than necessary resistance, or again the occurrence of noise in the gearbox 15 due to the rotation of each of the subordinate gears 42, 42'.

SUMMARY OF THE INVENTION

This invention has been created taking each of the above-mentioned disadvantages into consideration and aims to provide a drive mechanism for an automatic massaging apparatus whereby the load resistance of the support retaining the main drive shaft is made as uniform as possible, wherein the intermeshing noise of the two output shafts and the rotational gears of the output shafts is quieted, wherein the operational switch between the output shafts stemming from the forward and reverse rotation of the actuating motor is effected smoothly, wherein the noise emanating from the gearbox is prevented, and wherein a pleasant massage is carried out.

The drive mechanism according to this invention and as explained below is provided for the purpose of meeting these and other objectives.

Thus, by using the drive mechanism of this invention it is possible to make the load resistance of the support retaining the main drive shaft as uniform as possible and thus to smoothly carry out an operational switch between the subordinate shafts by means of the forward and reverse rotation of the starter motor, since the support retained by the spring is linked in screw fashion to the threaded portion on one extremity of the main drive shaft.

In addition to the rotation of each of the subordinate shafts being smooth, since the two subordinate shafts are respectively supported by bearings, it is also possible to prevent gearbox noise and to carry out a pleasant massage when each of the subordinate shafts are rotating since a resilient member is inserted between a first subordinate gear and the gearbox and between a rotating gear and the gearbox.

DETAILED DESCRIPTION

Figure 1:
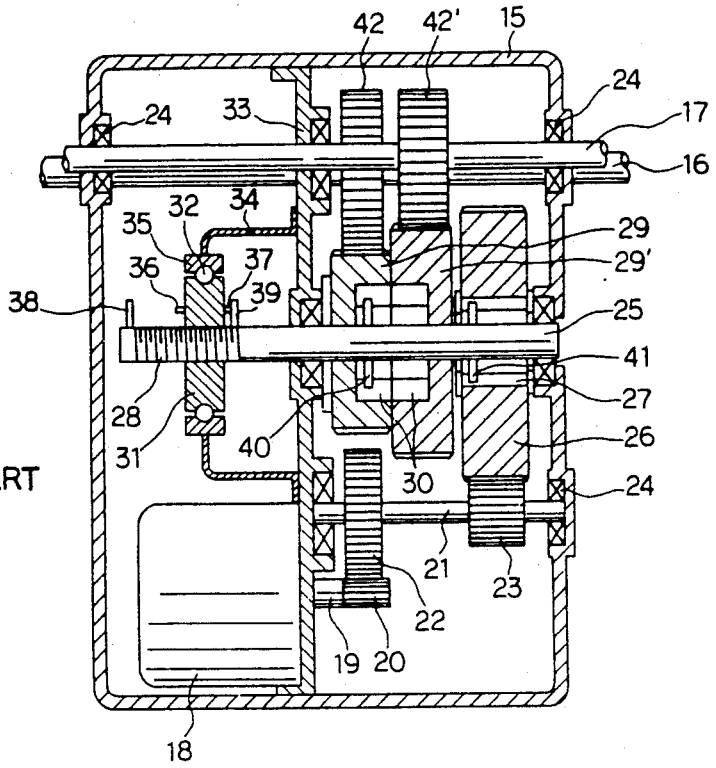
FIG. 1 PRIOR ART
FIG. 1 is a cross-sectional view showing a conventional drive mechanism for an automatic massaging apparatus.
Figure 2:
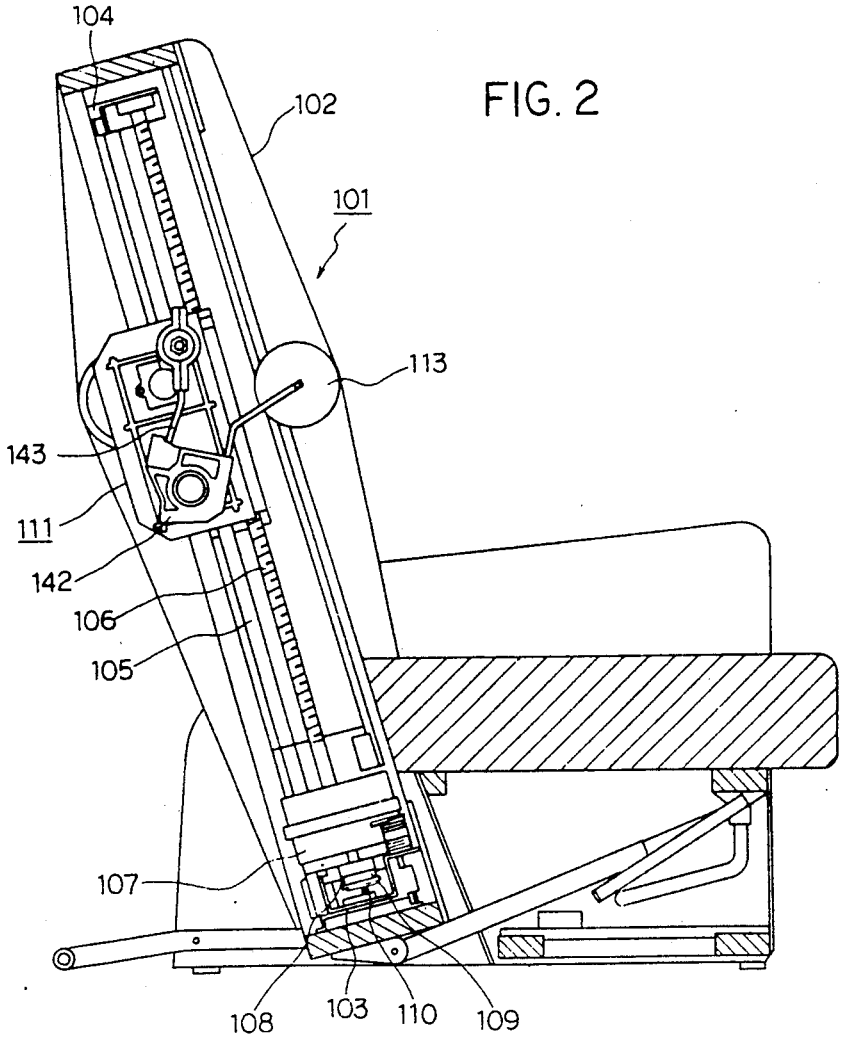
FIG. 2 is an explanatory view showing one embodiment of the drive mechanism in an automatic massaging apparatus of this invention.

FIG. 2 shows an embodiment of a chair-type automatic massaging apparatus 101 in which the drive mechanism of this invention is used. The massaging apparatus 101 is provided with a pair of parallel support rods 105 extending between a base plate 103 and a top plate 104 and positioned inside the backrest 102 of a chair. A screw shaft 106 is rotatable in forward and reverse directions by a drive motor 107, and is provided between and parallel to the support rods 105. A massaging mechanism 111, equipped with a pair of massaging rollers 113, is threadedly engaged with the screw shaft 106 and is vertically slidably guided by the rods 105 for freedom of elevational movement.

Moreover, a pulley 108 is fastened to the lower portion of the screw shaft 106, and it is coupled via a V-belt 110 to a motor pulley 109 attached to the drive motor 107.

Figure 3:
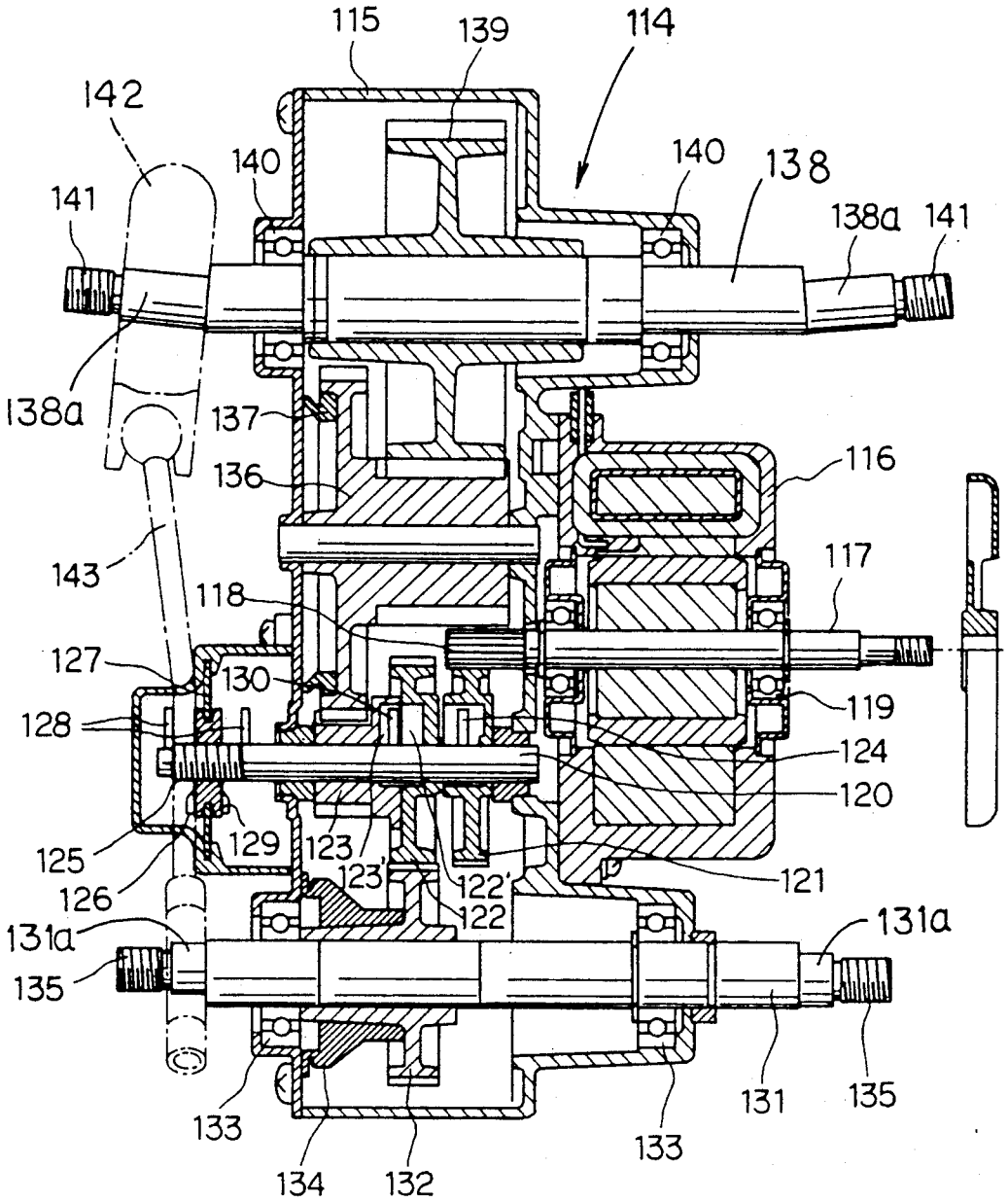
FIG. 3 is a cross-sectional view showing an embodiment of a drive mechanism in an automatic massaging apparatus of this invention.

Referring to FIG. 3, the massaging mechanism 111 includes a drive mechanism 114 arranged in such a way that it can carry out two different types of operation with the massaging rollers 113. The drive mechanism 114 is incorporated into the massaging mechanism 111 and constructed in such a way as to silently and independently turn two different subordinate shafts 131, 138 as well as to independently turn two different planetary gears 122, 123 (which are drivingly connected to the shafts 131, 138) by using the forward and reverse rotation of the main drive shaft 120 which rotates within the gearbox 115 and is engaged by the starter motor 116. The massaging rollers 113 are connectable via the connecting shaft 143 and connecting member 142, discussed below, on the opposite ends of both of the subordinate shafts 131, 138.

The actuating motor 116 is arranged in such a way as to turn a main drive gear 121 on the main drive shaft 120, which gear 121 meshes with gear teeth 118 formed on one end of the motor shaft 117. Both ends of the motor shaft 117 are supported by bearings 119, and one end of this shaft 117 is disposed within the gearbox 115.

A threaded portion 125 is cut into one end part of the main drive shaft 120, and a support nut 126, which is retained by a spring plate 127, is threadedly engaged with the threaded portion 125 in such a way that the main drive shaft 120 is supported elastically. Further, the two planetary gears 122, 123 are concentrically rotatably supported relative to shaft 120 and are provided with central slot-shaped recessed portions 122', 123' respectively, disposed in such a way that the recessed portions 122', 123' face one another. A follower pin 130 projects from shaft 120 and is contained in the recessed portions 122', 123', and a main drive pin 124 contained in a recess within the main drive gear 121 projects radially of the main drive shaft 120. These pins 124 and 130 are arranged in such a way that by their interlinkage it is possible to transmit rotational force to the two subordinate shafts 131, 138, as described below, by rotating the main drive shaft 120. As the main drive shaft 120 rotates, the engagement between the threaded portion 125 and the support 126 causes the drive shaft 120 to travel axially leftwardly or rightwardly in FIG. 3, according to its direction of rotation. Thus, the follower pin 130 moves axially between the recesses 122' and 123' of the gears 122 and 123, respectively, whereby selective rotation of the first and second support shafts 131 and 138 is effected.

Fixed pins 128 are provided projecting radially from opposite axial ends of the threaded portion 125 of the main drive shaft 120, and axially projecting locking pins 129 which are able to interlock with the fixed pins 128 are provided in the support 126. The whole arrangement is such as to be able to switch the transmission of the driving power to the two subordinate shafts 131, 138 as the support 126 moves in one or the other axial direction upon rotation of the main drive shaft 120 and one of the locking pins 129 engages against one of the fixing pins 128.

The first subordinate shaft 131 is supported at both ends thereof by bearings 133 and has a first subordinate gear 132 fixed thereon which rotates by meshing with the planetary gear 122 of the main drive shaft 120. An annular crown-shaped resilient (i.e. elastomeric) member 134 is axially inserted between the first subordinate gear 132 and the gearbox 115. The clattering noise of the gearbox 115 which occurs during rotation of the subordinate shaft 131 is absorbed by the resilient member 134 and controlled by the bearings 133 in such a way that the rotation can be as smooth as possible. The resilient member 134 seats on a radially outer peripheral surface of the first subordinate gear 132, and also seats on an axially facing inner surface of a wall portion of the gearbox 115.

The second subordinate shaft 138 is supported on both ends thereof by bearings 140 and has a second subordinate gear 139 fixed thereon which meshes with a rotational intermediate gear 136 which rotates by meshing with the planetary gear 123.

An annular crown-shaped resilient (i.e. elastomeric) member 137 is inserted between the rotational gear 136 and the gearbox 115 to absorb the noise caused by the clatter of the gearbox 115 which occurs during the rotation of the second subordinate shaft 138. The resilient member 137 seats on a radially inwardly facing surface of the rotational gear 136, and also seats on an axially facing wall portion of the gearbox 115.

The shafts 131 and 138 are supported with their rotational axes generally parallel with and on opposite sides of the drive shaft 120. Shaft 131 has radially eccentric support hubs **131*a* on opposite ends thereof. Shaft 138 also has radially eccentric support hubs 138*a* on opposite ends thereof, which hubs 138*a* are also slightly and oppositely angularly inclined relative to the axis of shaft 138**.

Figure 4:
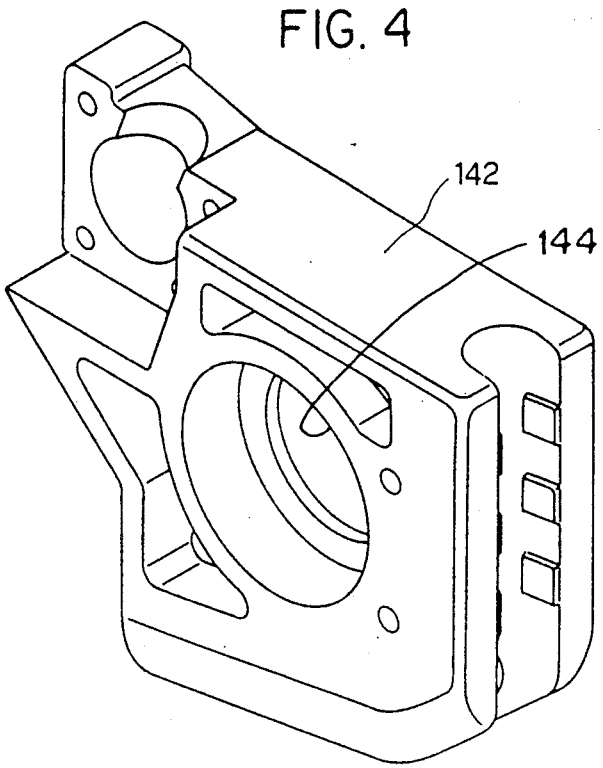
FIG. 4 is an isometric view showing an embodiment of the connecting member used in the drive mechanism of this invention.
Figure 5:
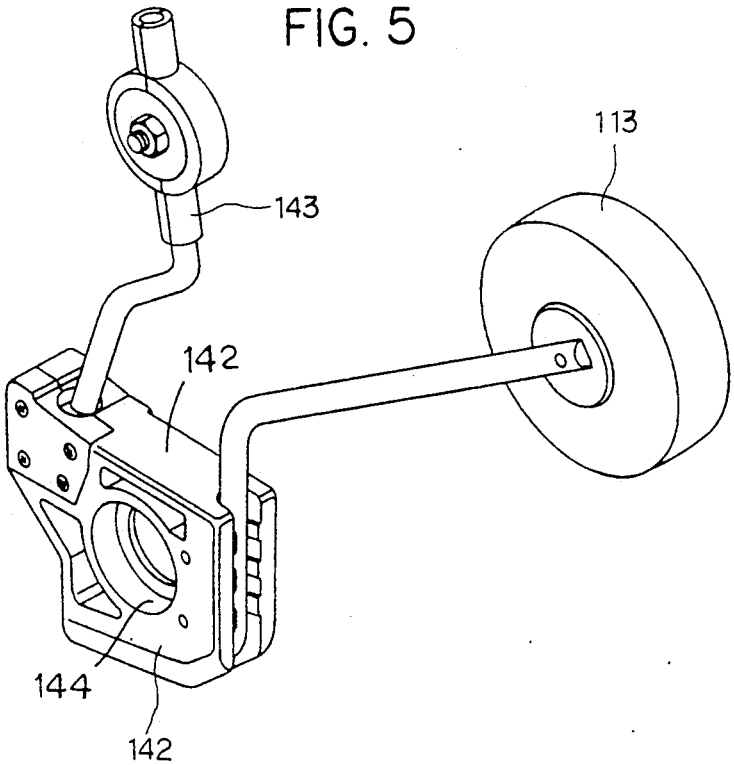
FIG. 5 is an isometric view showing an embodiment of the connecting shaft and connecting member used in the drive mechanism of this invention.

The first subordinate shaft 131 and the second subordinate shaft 138 are linked as shown in FIG. 3. Male threaded portions 141 are provided at both ends of the second subordinate shaft 138 to receive securing nuts (not shown). A connecting member 142 (one shown) is rotatably supported on each hub 138*a* of the shaft 138 via a bearing (not shown) or the like which is positioned in a central opening 144 of the member 142. Male threaded portions 135 are provided at both ends of the first subordinate shaft 131 to receive securing nuts (not shown). The top end of a connecting rod 143 (one shown) is rotatably supported on each eccentric hub 131*a* of the shaft 131. The bottom end of the connecting rod 143 is pivotally ball-supported on the respective connecting members 142 (FIGS. 3 and 5). Each massaging roller 113 is mounted on a support rod which is sandwiched and fixed in a recessed portion provided in the connecting member 142 (FIGS. 4 and 5).

In operation, rotation of motor shaft 117 in one direction causes drive shaft 120 to move axially leftwardly so that pin 130 engages slot 123' of gear 123, and the rightward pins 128–129 engage to effect rotation of nut 126 so as to prevent further axial displacement of shaft 120. Continued rotation of shaft 120 and gear 123 effects driving rotation of intermediate gear 136, which in turn rotates the output shaft 138. The corresponding rotation of eccentric hubs 138*a* cause oscillating (reciprocating) movement of connecting members 142 and of the rollers 113 mounted thereon.

On the other hand, when motor shaft 117 is rotated in the opposite direction, shaft 120 moves axially rightwardly so that pin 130 engages slot 122' of gear 122, and the leftward pins 128–129 engage to prevent further axial displacement of drive shaft 120. The rotation of shaft 120 and gear 122 effects driving rotation of gear 132 and of output shaft 131. The corresponding rotation of eccentric hubs 131*a* effects cyclic movement of connecting rods 143, which in turn cause cyclic rocking of the connecting members 142 and of the rollers 113 mounted thereon.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a chair-type massaging apparatus including a back rest portion, a vertically extending and reversibly rotatable screw shaft arranged in said back rest portion, a massaging mechanism threadedly engaged with said screw shaft and supported for up and down vertical movement along said back rest portion, said massaging mechanism including a pair of massaging rollers, the improvement comprising:

a drive mechanism arranged in said massaging mechanism for driving said rollers, said drive mechanism including a reversible drive motor, an axially movably supported drive shaft having opposite ends which are rotatably supported in said massaging mechanism, said drive shaft being reversibly rotatably driven by said drive motor, two substantially parallel output shafts, first and second gear trains respectively drivingly connecting said output shafts to said drive shaft for rotation therewith about respective rotational axes, each of said gear trains including a drive gear, said output shafts having hubs provided at opposite ends thereof which are radially eccentric relative to respective said rotational axes of said output shafts, said hubs of one of said output shafts being oppositely angularly inclined relative to said rotational axis of said one output shaft;

clutch means for selectively engaging said drive gears with said drive shaft for rotation therewith; and linkage means for linking each of said rollers with a respective said hub of each said output shaft, said linkage means including a connecting member and a connecting rod associated with each said roller, means for defining a ball and socket joint between said connecting member and said connecting rod, said connecting member being rotatably supported on one said hub of said one output shaft, said connecting rod being rotatably supported on one said hub of the other said output shaft, an arm for supporting each said roller cantilevered from the associated said connecting member, said arm having a fixed end connected to said connecting member and a free end which mounts said roller, said one output shaft being interposed between said fixed end of said arm and said ball and socket joint.

2. The apparatus according to claim 1, including a gearbox for housing said gear trains, each said gear train including a driven gear which is driven by a respective said drive gear, each of said driven gears having elastomeric noise damping means provided thereon for damping noise produced by rotation of said driven gear in said gearbox.

3. The apparatus according to claim 1, wherein said clutch means includes an internally threaded support nut which is threadedly engaged with one said end of said drive shaft in surrounding relationship thereto, a planar plate spring radially surrounding said support nut and having a radially outer edge which is fixed relative to said support nut and said drive shaft, said plate spring having a radially inner edge on which said support nut is supported and yieldably restrained against rotation relative to said plate spring, said drive shaft being reversibly axially displaced during rotation thereof due to said threaded engagement thereof with said yieldably rotatably restrained support nut.

4. In an automatic massaging apparatus including a massaging mechanism equipped with a pair of massaging rollers, a motor which rotates in forward and reverse directions, and a screw shaft driven by said motor and threadedly engaged with said massaging mechanism to raise or lower said massaging mechanism, the improvement comprising:

a drive mechanism incorporated into said massaging mechanism, said drive mechanism including an axially movably supported main drive shaft having opposite ends which are rotatably supported in said massaging mechanism, a reversible motor for effecting reversible rotation of said main drive shaft, two drive gears carried on said main drive shaft, a pair of subordinate shafts and bearings for rotatably supporting said subordinate shafts in said massaging mechanism, a rotational gear drivingly engaged between one of said drive gears and one of said subordinate shafts, and a first subordinate gear drivingly engaged between the other said drive gear and the other said subordinate shaft, a gearbox for housing said first subordinate gear and said rotational gear therein, and elastomeric members respectively inserted between the gearbox and each of said subordinate gear and said rotational gear;

means for permitting only one of said drive gears to rotate with said main drive shaft during rotation thereof in a forward direction and for permitting only the other said drive gear to rotate with said main drive shaft during rotation thereof in a reverse direction, including an internally threaded support nut which is threadedly engaged with one said end of said drive shaft in surrounding relationship thereto, a planar plate spring radially surrounding said support nut and having a radially outer edge which is fixed relative to said support nut and said drive shaft, said plate spring having a radially inner edge on which said support nut is supported and yieldably restrained against rotation relative to said plate spring, said main drive shaft being reversibly axially displaced in response to reversible rotation thereof due to said threaded engagement thereof with said yieldably rotatably restrained support nut, said drive gears being supported on said main drive shaft for rotation relative thereto, a pin fixed to and extending radially from said main drive shaft, said pin being carried with said main drive shaft for reversible axial movement between a first axial position in which said pin locks one of said drive gears for rotation with said main drive shaft and a second axial position in which said pin locks the other of said drive gears for rotation with said main drive shaft.

5. The apparats according to claim 4, wherein said massaging mechanism includes a connecting member and a connecting rod associated with each of said massaging rollers, said subordinate shafts being generally parallel to one another and having opposite ends, each of said massaging rollers being connected to one said end of one said subordinate shaft by the associated said connecting member, and each of said massaging rollers being connected to one said end of the other said subordinate shaft by the associated said connecting rod.

6. The apparatus according to claim 5, wherein said rotational gear and said first subordinate gear have respective radially facing annular surfaces, said elastomeric members having an annular construction and being respectively seated on said radially facing annular surfaces, said gearbox having axially facing wall portions, and said elastomeric members also seating against respective said axially facing wall portions of said gearbox.

7. The apparatus according to claim 6, wherein said first subordinate gear is fixed on said other subordinate shaft, a second subordinate gear being fixed on said one subordinate shaft said second subordinate gear being engaged with said rotational gear, said radially facing annular surface of said rotational gear facing radially inwardly, and said radially facing annular surface of said first subordinate gear facing radially outwardly.

8. The apparatus according to claim 7, wherein said subordinate shafts are rotatable about respective rotational axes thereof, each said subordinate shaft including reduced diameter end portions which are eccentric with respect to the associated rotational axis, said reduced diameter eccentric end portions of said one subordinate shaft being slightly and oppositely angled relative to the rotational axis of said one subordinate shaft.

9. The apparatus according to claim 8, wherein said connecting members are rotatably supported on respective said eccentric end portions of said one subordinate shaft, said connecting rods being rotatably supported on respective said eccentric end portions of said other subordinate shaft, respective pairs of said connecting members and said connecting rods as associated with each said massaging roller including means defining a ball and socket joint therebetween, each of said massaging rollers being supported on the associated said connecting member.

* * * * *